US011828113B2

(12) United States Patent
De Lemos Junior et al.

(10) Patent No.: US 11,828,113 B2
(45) Date of Patent: Nov. 28, 2023

(54) INSTALLING SUBSEA RISERS

(71) Applicant: Subsea 7 do Brasil Servicos Ltda, Niteroi (BR)

(72) Inventors: Luiz Carlos De Lemos Junior, Rio de Janeiro (BR); Andre Ramiro Amorim, Rio de Janeiro (BR); Gustavo Queiroz Hepner, Rio de Janeiro (BR); Frederico Nicoletti de Fraga, Niteroi (BR); Joao Carlos Carvalho Gouveia, Rio de Janeiro (BR); Ivan Carlos Pimentel da Cruz, Niteroi (BR); Yann Brouard, Velizy (FR); Daniel Karunakaran, Tananger (NO)

(73) Assignee: Subsea 7 do Brasil Servicos LTDA, Rio de Janeiro (BR)

( * ) Notice: Subject to any disclaimer, the term of this patent is extended or adjusted under 35 U.S.C. 154(b) by 0 days.

(21) Appl. No.: 17/416,944

(22) PCT Filed: Dec. 19, 2019

(86) PCT No.: PCT/BR2019/050550
§ 371 (c)(1),
(2) Date: Jun. 21, 2021

(87) PCT Pub. No.: WO2020/124186
PCT Pub. Date: Jun. 25, 2020

(65) Prior Publication Data

US 2022/0081977 A1 Mar. 17, 2022

(30) Foreign Application Priority Data

Dec. 19, 2018 (GB) ..... 1820760

(51) Int. Cl.
*E21B 17/08* (2006.01)
*E21B 17/01* (2006.01)
(Continued)

(52) U.S. Cl.
CPC ..... *E21B 17/085* (2013.01); *E21B 17/012* (2013.01); *E21B 33/038* (2013.01); *E21B 41/10* (2013.01)

(58) Field of Classification Search
CPC ..... E21B 17/085; E21B 17/012; E21B 33/038
See application file for complete search history.

(56) References Cited

U.S. PATENT DOCUMENTS 4,673,313 A * 6/1987 Baugh ..... E21B 43/0107 166/341
4,676,696 A * 6/1987 Laursen ..... F16L 1/26 405/169

(Continued)

FOREIGN PATENT DOCUMENTS

CN 2014329044 2/2015
CN 105525888 4/2016

(Continued)

OTHER PUBLICATIONS

ANSI/API Specification 17J, "Specification for Unbonded Flexible Pipe," 3d ed. 2008.

(Continued)

*Primary Examiner* — Aaron L Lembo
(74) *Attorney, Agent, or Firm* — Mattingly & Malur, PC

(57) ABSTRACT

An end fitting for a subsea riser comprises an engagement head to be engaged with a subsea foundation in a vertically downward longitudinal direction. A structure of the end fitting surrounds a longitudinally extending flow axis and is arranged to bear a tensile load on a load path extending longitudinally from the engagement head parallel to the flow axis. The structure includes a pivot joint assembly having a first part attached to or integral with the engagement head and a second part pivotable relative to the first part about a centre of rotation substantially aligned with the flow axis. The structure can be fixed to the engagement head or (Continued)

removably attached to the engagement head. The engagement head supports an upwardly facing connector hub that is offset laterally from the flow axis. A connector pipe in fluid communication with the connector hub extends from the flow axis to the connector hub. A counterweight is opposed to the connector hub and the connector pipe about the flow axis.

24 Claims, 4 Drawing Sheets

(51) Int. Cl.
*E21B 33/038* (2006.01)
*E21B 41/10* (2006.01)

(56) References Cited

U.S. PATENT DOCUMENTS 7,025,535 B2 4/2006 Chiesa et al.
7,191,836 B2 3/2007 Bhat et al.
7,314,084 B2 * 1/2008 Rodrigues ..... E21B 43/128 166/344
7,404,695 B2 7/2008 Chenin
2005/0196243 A1 * 9/2005 Pollock ..... E21B 17/085 166/350
2012/0273213 A1 11/2012 Blalock et al.

FOREIGN PATENT DOCUMENTS

GB 2473018 3/2011
WO WO 2066786 8/2002
WO WO 03095788 11/2003
WO WO 2014/043126 3/2014
WO WO 2014/120130 8/2014

OTHER PUBLICATIONS

API Specification 5L, "Specification for Line Pipe," 45th ed. 2013.
API Recommended Practice 17B, "Recommended Practice for Flexible Pipe," 5th ed. 2014.
API Recommended Practice 1111, "Design, Construction, Operation, and Maintenance of Offshore Hydrocarbon Pipelines (Limit State Design)," 5th ed. 2015.
Tan, Ruilong et al., "Numerical calculation model investigation on response for connector assembly of a free-standing hybrid riser with experimental validation," Ocean Engineering, vol. 155, pp. 144-155, May 2018.

* cited by examiner

INSTALLING SUBSEA RISERS

This invention relates to the installation of subsea risers as used in the subsea oil and gas industry, and especially to the challenges of connecting a riser with substantially vertical bottom orientation to subsea equipment.

Subsea risers are used to convey hydrocarbon production fluids from the seabed to the surface and conversely to convey other fluids from the surface to the seabed, such as water for injection into a subsea well. The invention aims to simplify the installation of such risers. The invention may also simplify the removal of such risers, where required.

A common free-hanging riser comprises a rigid pipeline that hangs freely as a catenary from a floating upper support such as an FPSO (floating production, storage and offloading) vessel, a platform or a buoy. When the riser has a catenary shape, the bottom of the riser bends to the horizontal to follow the seabed. The horizontal part of the riser is then simple to connect to a horizontal flowline via an end termination module, or to other equipment on the seabed. In principle, it is also possible for the horizontal part of the riser to continue across the seabed to serve as a flowline itself.

Most conventionally, a free-hanging catenary riser of rigid pipe is made of steel, hence being known in the art as a steel catenary riser or SCR. In this respect, those skilled in the art know that nominally rigid pipes are not devoid of flexibility. However, whilst they have flexibility, 'rigid' pipes do not fall within the definition of 'flexible' pipes as understood in the art.

Conventional rigid pipes used in the subsea oil and gas industry are specified in the American Petroleum Institute (API) Specification 5L and Recommended Practice 1111. A rigid pipe usually consists of, or comprises, at least one pipe of solid steel or steel alloy. However, additional layers of other materials can be added, such as an internal liner layer or an outer coating layer. A rigid pipe may also have a concentric pipe-in-pipe (PiP) structure. Rigid pipe joints are terminated by a bevel, a thread or a flange, and are assembled end-to-end by welding, screwing or bolting them together to form a pipe string or pipeline.

A riser suspended between a floating vessel or platform and the seabed moves in multiple directions on various timescales and frequencies throughout its operational life. Motion of the riser is driven by multiple inputs, notably: motion of the supporting vessel or platform expressed as heave, pitch, roll and yaw; seawater motion caused by currents, tides and waves, including flows that promote vortex-induced vibration (VIV); and pipeline motion across the seabed, known in the art as walking. Repetitive or oscillatory motion generates fatigue in a riser that may, over time, cause its failure and rupture.

A simple free-hanging rigid riser such as an SCR has advantages of low cost and ease of installation. However, such a simple riser solution is not technically viable for some more challenging projects, especially in dynamic environments that will often suffer from high sea states and strong currents. Other solutions may be appropriate to construct subsea risers in those situations, for example using flexible pipes and pipes of composite materials.

Flexible pipes used in the subsea oil and gas industry are specified in API Specification 17J and Recommended Practice 17B. The pipe body is composed of a composite structure of layered materials, in which each layer has its own function. Typically, polymer tubes and wraps ensure fluid-tightness and thermal insulation, whereas steel layers or elements provide mechanical strength.

Bonded flexible pipes comprise bonded-together layers of steel, fabric and elastomer but can only be manufactured in short lengths in the order of tens of metres. Such pipes are therefore apt to be used as jumper pipes in hybrid buoy-supported risers that hang SCRs from a sub-surface buoy, or in hybrid riser towers in which an upright riser column is held in tension between a sub-surface buoy and a subsea foundation. Conversely, fully-flexible risers of unbonded flexible pipe can be manufactured in lengths of hundreds of metres and so are long enough to reach from the seabed to the surface. However, unbonded flexible pipe is very expensive and has limited flow capacity and resistance to differential pressure.

In view of these challenges, the subsea oil and gas industry has begun to adopt rigid pipes of polymer composite materials in place of steel in recent years. Composite pipes have a tubular load-bearing structure that is principally of composite materials. This is to be distinguished from pipes having a composite structure, such as the various layered configurations of rigid and flexible pipes mentioned above.

Typically, a composite pipe comprises a polymer resin matrix reinforced by fibres such as glass fibres or carbon fibres. The polymer matrix may be of thermoplastic or thermoset materials. The former results in what is known in the art as thermoplastic composite pipe or, more simply, as thermo-composite pipe, known by the acronym TCP.

TCP is classed as a bonded composite pipe. It has a solid, monolithic structure comprising a polymer liner, a polymer composite matrix and an optional outer coating that may also be of polymer. The polymer of the liner, the matrix and/or the coating may, for example, be of polypropylene. The matrix is a true composite reinforced with fully-embedded reinforcing fibres.

In an alternative or additional approach to reducing fatigue, a riser may be shaped to impart compliance by adding localised buoyancy and/or weights to modify the curvature of the riser and, in particular, to introduce points of inflection.

In essence, two options are available for installing a subsea production or water injection riser, namely: initiating the riser at the bottom and then pulling it upwards; or suspending the top end of the riser from the surface and subsequently connecting its bottom end to subsea equipment. The second approach is faster and more convenient for lightweight risers, such as those made from unbonded flexible pipe or TCP.

The bottom of a non-catenary riser does not bend to the horizontal but instead is substantially vertical. This applies to riser columns and to other riser configurations that are held in tension above a subsea foundation. As vertical orientation precludes simple end-to-end connection to a flowline on the seabed, an interface is needed. An example of such an interface is disclosed in U.S. Pat. No. 7,191,836.

Additionally, in service, an upright riser column has to be able to pivot relative to any subsea foundation or other fixed base structure to which it is attached. GB 2473018 discloses a conventional solution in which the bottom of the riser is mechanically connected to the structure by a flexible connection such as a flexible joint or a Rotolatch-type connector. Rotolatch is a registered trade mark of Oil States Industries, Inc. This flexible mechanical connection is distinct from the fluid transport line.

WO 2014/043126 discloses a vertical, rigid, self-standing riser that is connected to a foundation by a flexible joint. Both mechanical connection and fluid connection are effected by a pivotable end fitting. It is difficult to achieve proper alignment to make these connections when the riser is light, for example a buoyant or composite riser.

In WO 03/095788 and WO 02/066786 a static structure on the seabed serves as the interface between a pipeline on the seabed and a vertical riser. The bottom end of the vertical riser comprises a flexible joint to allow angular deviation from the vertical axis before connection.

CN 105525888 relates to a two-part free-standing hybrid riser having a vertically-extending lower riser assembly and a flexible upper riser assembly. CN 104329044 describes a lower terminal connector that is provided at the lower end of a riser assembly.

US 2012/0273213 describes a riser having a lower end that is fluidly coupled to a seal stem, the seal stem in turn being fluidly attached to a lower riser assembly through a polished bore receptacle.

Against this background, the invention provides an end fitting for a subsea riser. The end fitting comprises: an engagement head that is arranged to be engaged with a subsea foundation in a longitudinal engagement direction; a structure surrounding a longitudinally-extending flow axis, which structure is arranged to bear a tensile load on a load path that extends longitudinally from the engagement head in parallel to the flow axis; a connector hub that is offset laterally from the flow axis; a connector pipe in fluid communication with the connector hub, which pipe extends from the flow axis to the connector hub; and a counterweight that is opposed to the connector hub and the connector pipe about the flow axis. The engagement head is configured to support the connector hub, the connector pipe and the counterweight.

The connector hub may face in a direction opposed to the engagement direction, for example in a direction substantially parallel to the flow axis. In that case, the connector pipe may be substantially U-shaped, defining a first limb that is aligned with the connector hub and a second limb that is aligned with the flow axis.

The connector hub and the counterweight may be located within a substantially matching pair of funnel formations. The pair of funnel formations may be substantially bisected by a central plane that contains the flow axis.

In combination, the end fitting of the invention may be attached to a riser conduit that is coaxial with the flow axis. In that case, the riser conduit could extend along the flow axis through the structure.

The structure may be removably connectable to the engagement head. For example, the structure may be connectable to the engagement head by a subsea connector comprising complementary connector elements that surround the flow axis when inter-engaged. In that case, the engagement head and the structure may comprise complementary guide parts that are spaced laterally from the flow axis and that are inter-engageable along an alignment axis that extends parallel to the flow axis. The guide parts may include complementary helical orientation formations that are arranged to move one of the connector elements into alignment with the other of the connector elements on the flow axis.

The structure includes a pivot joint assembly having a first part that is attached to or integral with the engagement head and a second part that is pivotable relative to the first part about a centre of rotation substantially aligned with the flow axis. The first and second parts of the pivot joint assembly may, for example, be joined by a universal joint or a flexible joint.

The inventive concept extends to a subsea riser that comprises an end fitting of the invention. Such a riser may comprise a riser conduit of composite pipe or flexible pipe. The riser may be engaged with the subsea foundation with the flow axis of the end fitting in a substantially vertical orientation.

The inventive concept also embraces an engagement head for a subsea riser. The engagement head is arranged to be engaged with a subsea foundation in a longitudinal engagement direction and comprises: a connector hub that is offset laterally from a central longitudinally-extending flow axis; a connector pipe in fluid communication with the connector hub, which pipe extends from the flow axis to the connector hub; and a counterweight that is opposed to the connector hub and the connector pipe about the flow axis.

The connector hub and the counterweight may be disposed substantially symmetrically about the flow axis and may be located within respective funnel formations.

The inventive concept also extends to corresponding methods of installing a subsea riser. One such method comprises: lowering the riser toward a seabed foundation with at least a bottom end portion of the riser in a substantially vertical orientation; in an engagement head at a bottom end of the riser, counterbalancing the weight of a connector hub that is offset laterally from a flow axis extending substantially vertically through the engagement head and the weight of a connector pipe that extends from the flow axis to the connector hub; and mechanically engaging the engagement head with the seabed foundation.

The engagement head is apt to be moved into engagement with the seabed foundation in a substantially vertical engagement direction.

The engagement head is suspended while allowing a conduit of the riser to pivot relative to the engagement head away from alignment with the flow axis that extends through the engagement head.

Hydrodynamic forces may act on a guide funnel around the connector hub while lowering the riser. Such forces are offset laterally from the flow axis that extends through the engagement head and so are preferably also counterbalanced.

Another method of installing a subsea riser in accordance with the invention comprises: lowering an engagement head while counterbalancing the weight of a connector hub that is offset laterally from a flow axis extending substantially vertically through the engagement head and the weight of a connector pipe that extends from the flow axis to the connector hub; mechanically engaging the engagement head with the seabed foundation; and coupling a riser conduit to the engagement head engaged with the foundation.

The riser conduit is allowed to pivot relative to the engagement head away from alignment with the flow axis that extends through the engagement head.

The riser conduit may be guided onto the flow axis that extends through the engagement head by inter-engaging complementary guide parts of the engagement head and of the riser conduit.

The connector hub may be supported in a substantially vertical orientation when the engagement head is engaged with the foundation.

Embodiments of the invention implement a method for connecting a riser with substantially vertical bottom orientation to static subsea equipment, the method comprising the following steps: installing a foundation structure on the seabed; mounting an end fitting at the bottom end of a riser pipe, that end fitting being able to rotate at least partially with regard to the riser pipe; deploying the riser into water from surface; and connecting the end fitting to the foundation structure.

The end-fitting may, for example, be connected to the riser pipe by a gimbal joint or a flexible joint. The foundation structure may, for example, comprise a suction pile and a top interface.

In a first option, the end fitting may be integral with an upper structure comprising a mechanical interface with the foundation structure, a bent rigid pipe terminated by a connector hub and a counterweight that balances the bent rigid pipe during lowering through water. The bent rigid pipe may be U-shaped so that the connector hub has a vertical axis. The connector hub may be inside a guiding funnel.

In a second option, the end fitting may comprise a vertical connector hub to fluidly connect to an upper structure that is integral with or separately attachable to a top interface of the foundation structure, the upper structure also comprising a bent rigid pipe terminated by a connector hub and a counterweight balancing the bent rigid pipe. The end fitting and the upper structure suitably comprise a mutually-complementary guide system such as a funnel and a guide post.

An advantage of preferred embodiments of the invention is to facilitate vertical installation of the riser without the necessity of a jumper pipe to connect to a flowline on the seabed, hence reducing the cost of the installation. A jumper pipe is an external rigid or flexible pipe that connects a subsea structure such as a pipeline end termination (PLET) to a bottom connector of a riser. The bottom connector is an end fitting that connects the riser substantially vertically under tension at the seabed.

The equipment of the invention is suitable for Steep Wave, CVAR (Compliant Vertical Access Riser) or any other riser configuration in which the riser is connected under tension to the seabed through a bottom connector. The riser may or may not have a declination or inclination relative to the vertical. The equipment of the invention can be installed by any pipelaying technique such as J-lay, S-lay or reel-lay.

Embodiments of the invention employ a gimbal joint, universal joint or flexible joint. A pile connector with a counterweight, funnel guide, API connector hub and 3D steel pipe is connected to a pile head during riser installation. Riser installation is performed with a male component of the funnel guide, counterweight and connector hub already connected to the riser, together with the gimbal joint. This option is particularly appropriate for a configuration having one riser per pile or other foundation.

The universal joint has a mirror termination between the upper riser and a length of TCP inside the joint that is connected to the lower end. This mirror termination allows the upper end of the joint to be fixed to the connector in order to transfer tension loads through the armour or structure of the joint instead of passing through the TCP extending within.

Embodiments of the invention enable decoupled installation of a pile connector, reflecting the possibility to install a male component comprising a funnel guide and connector hub as the pile connector before installing a riser that terminates in a flexible or universal joint. There is also the possibility of installing the pile already connected to the male component of the funnel, counterweight and hub. This arrangement is appropriate for a group of risers attached to the same pile and has the further advantage that it is not necessary to remove the entire assembly in case of riser recovery.

In summary, the invention provides an end fitting for a subsea riser, comprising an engagement head that is arranged to be engaged with a subsea foundation in a downward longitudinal direction. A structure of the end fitting surrounds a longitudinally-extending flow axis. The structure is arranged to bear a tensile load on a load path that extends longitudinally from the engagement head in parallel to the flow axis. The structure may be fixed to the engagement head or may be removably attached to the engagement head.

The engagement head supports an upwardly-facing connector hub that is offset laterally from the flow axis. A connector pipe in fluid communication with the connector hub extends from the flow axis to the connector hub. A counterweight is opposed to the connector hub and the connector pipe about the flow axis.

In order that the invention may be more readily understood, reference will now be made, by way of example, to the accompanying drawings in which.

Figure 2:
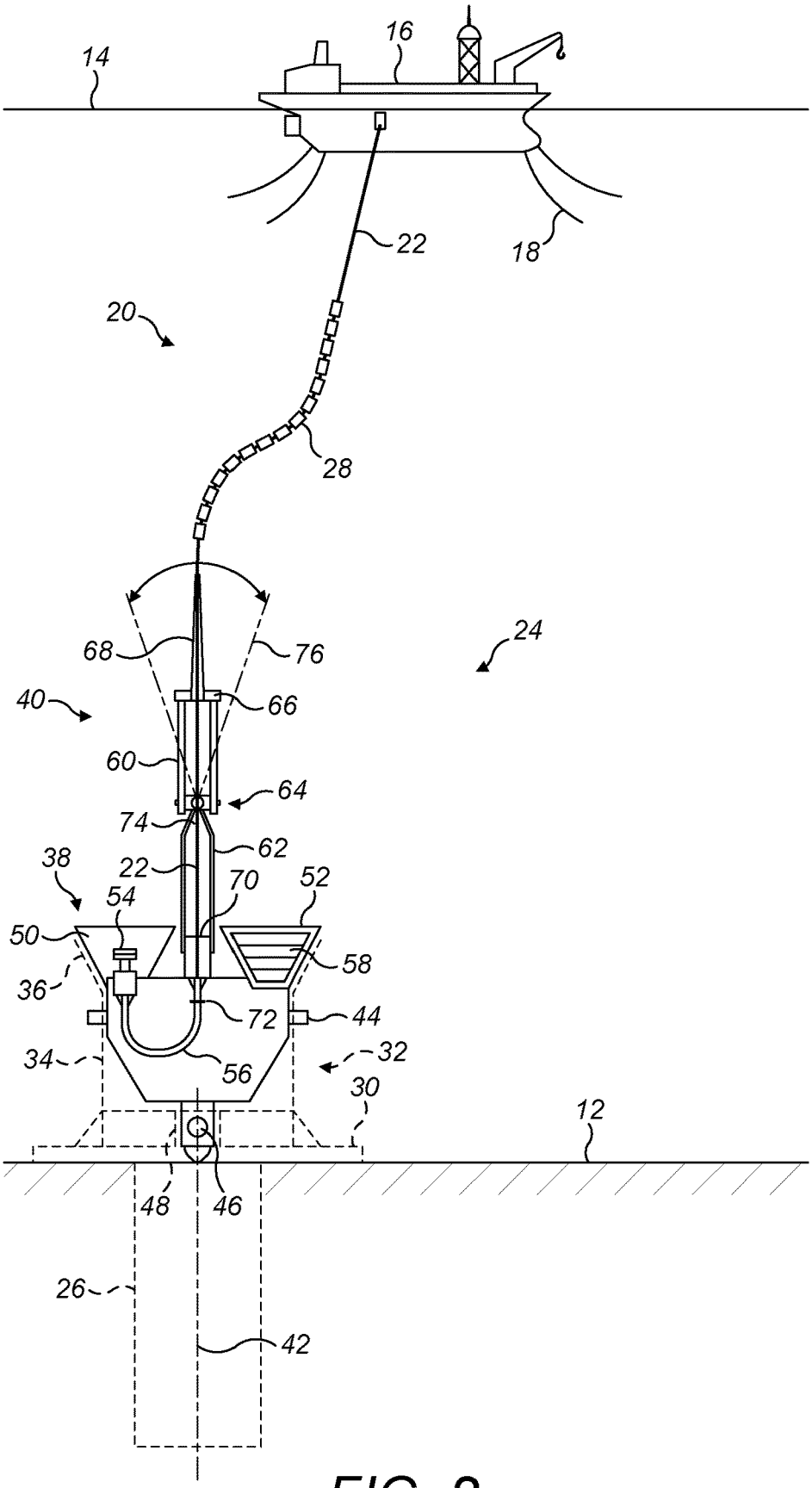
FIG. 2 is a schematic part-sectional side view of one of the risers of the system shown in FIG. 1, showing details of a bottom connector of the invention.
Figure 3:
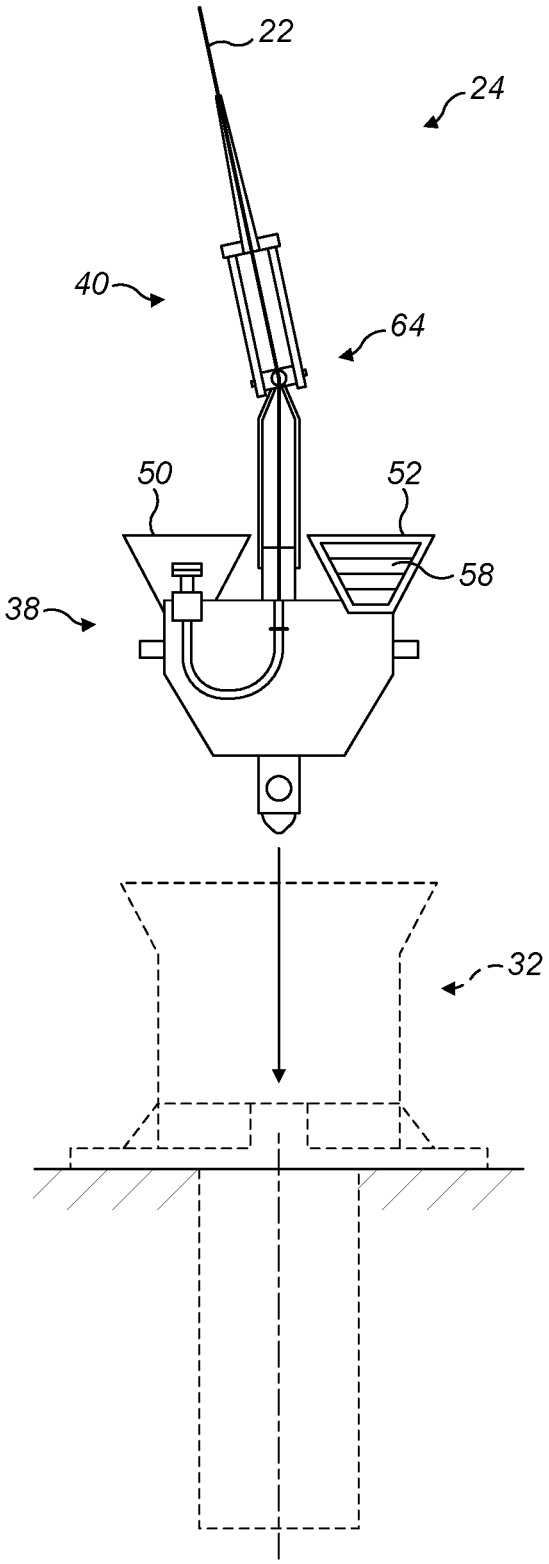
Figure 4:
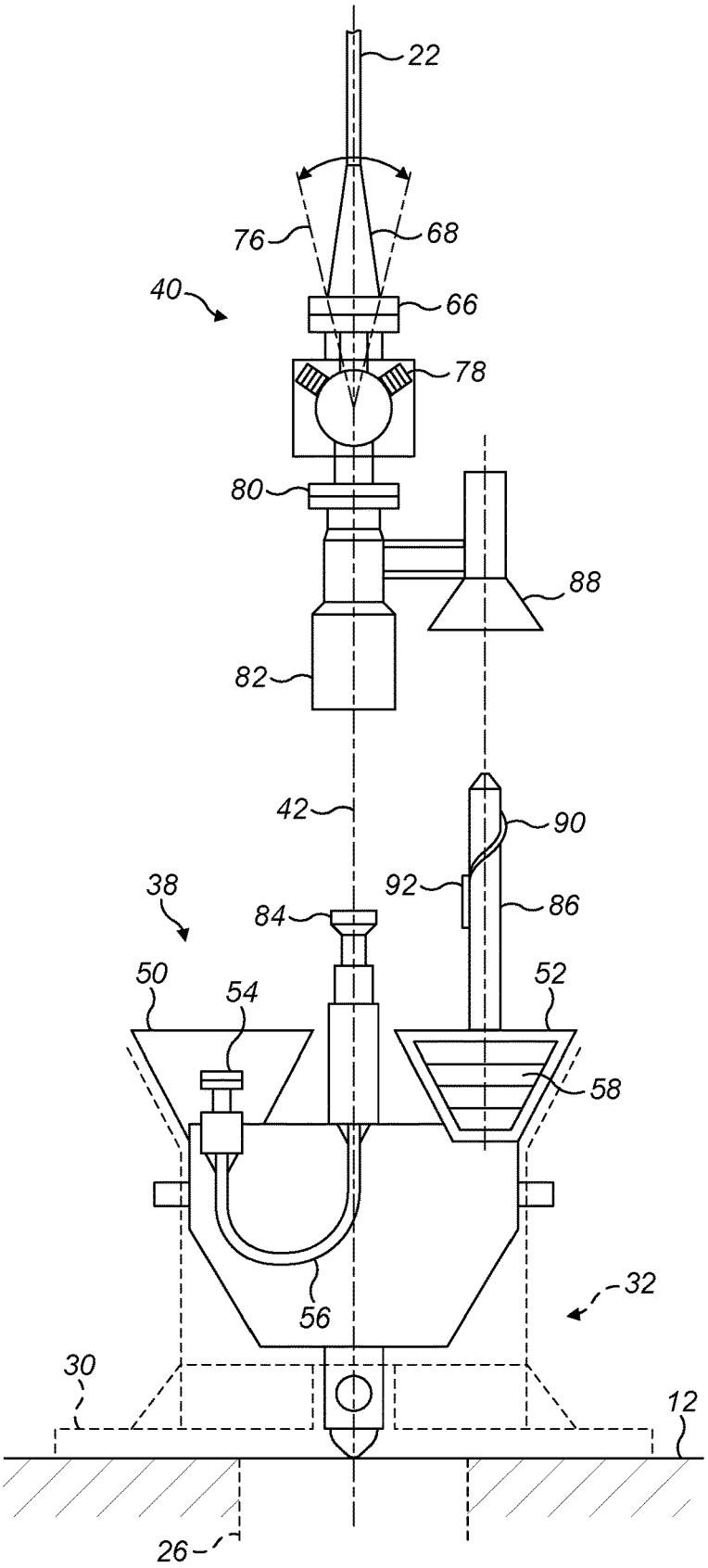

FIG. 3 corresponds to FIG. 2 and shows the bottom connector in the water column approaching a subsea foundation to which the bottom connector is shown attached in FIG. 2; and FIG. 4 is a schematic part-sectional side view of a variant of the bottom connector shown in FIGS. 2 and 3.

Figure 1:
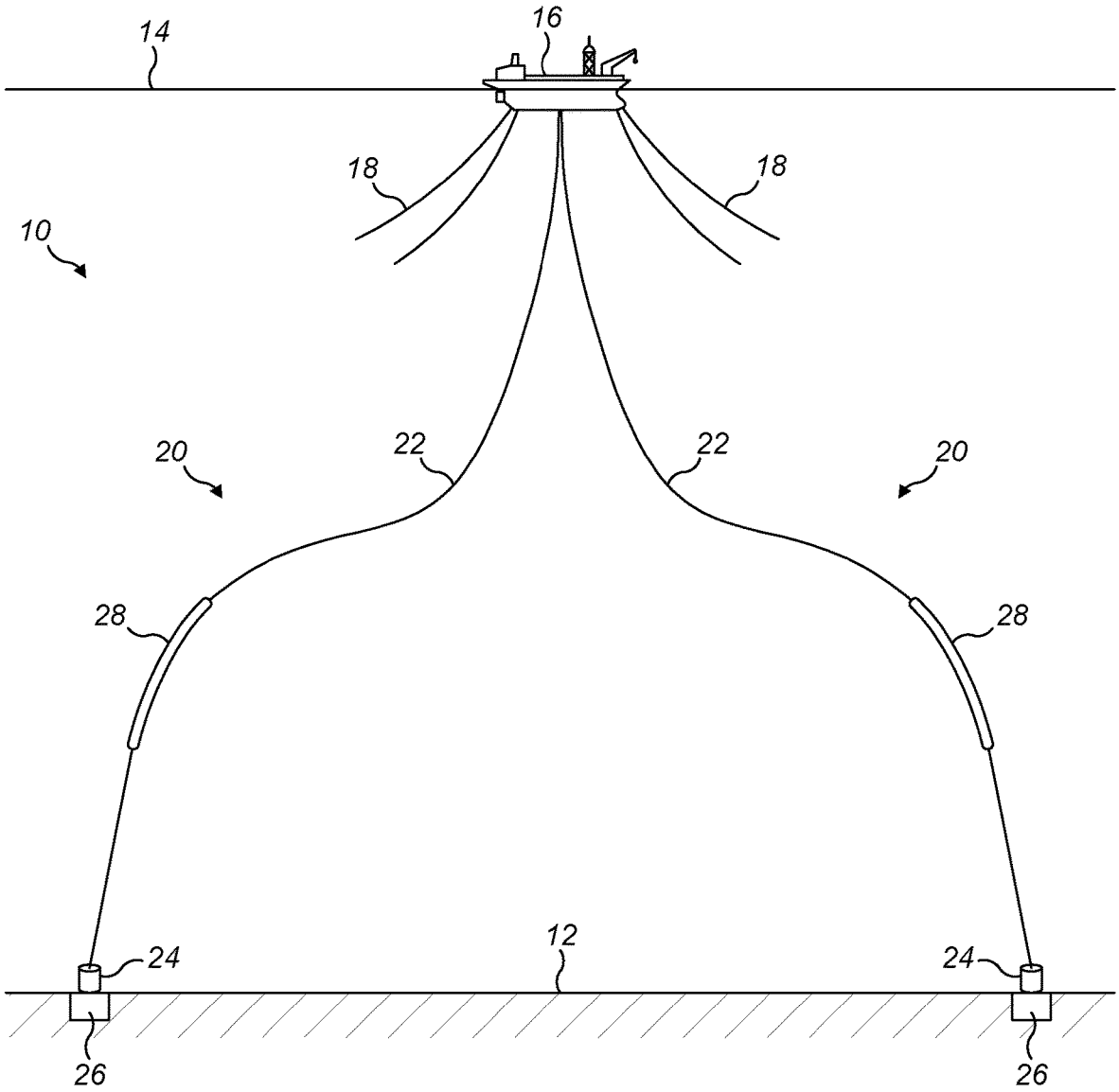
FIG. 1 is a side view of a riser system of a subsea installation for the production of oil and gas.

FIG. 1 shows part of a riser system 10 of a subsea installation for the production of oil and gas. The riser system 10 extends from the seabed 12 to the surface 14, where it connects to a surface installation that is exemplified here as an FPSO 16. The FPSO 16 is held in position at the surface 14 by conventional spread moorings 18.

In practice, the riser system 10 will comprise multiple risers 20 but only two of those risers 20 are shown in the simplified view of FIG. 1, opposed symmetrically about a vertical central plane that intersects the FPSO 16. Each riser 20 comprises a conduit 22 of lightweight, buoyant pipe such as TCP and has a bottom connector 24 of the invention at its base that connects the riser 20 to the seabed 12 via a respective foundation 26. FIG. 1 also omits subsea flowlines that, in practice, will extend across the seabed 12 to connect with the base of each riser 20 through its bottom connector 24.

To allow for heave of the FPSO 16, buoyancy 28 is added at an intermediate location along the length of each riser 20 to confer a curved compliant shape on the riser 20. In this example, the risers 20 have a CVAR configuration. Other riser configurations such as a Steep Wave configuration are possible, or any other configuration in which a riser is connected to the seabed 12 under tension through a bottom connector 24.

The bottom connector 24 of a riser configuration like CVAR is at a bottom end portion of the riser 20 whose orientation is upright and typically is substantially vertical. In this respect, it will be noted that the bottom end portions of the risers 20 in FIG. 1 are upright but are pulled away from a perfectly vertical axis by their asymmetric shape and by tension between the upthrust of the FPSO 16 and the buoyancy 28 acting against the reaction force of their foundations 26.

It is known to construct risers with configurations like these from rigid steel pipe. However, where a riser 20 is of a lightweight pipe such as TCP, aligning and coupling the bottom connector 24 with the foundation 26 becomes more challenging. Alignment is particularly problematic where, as here, the bottom connector 24 has asymmetric pipework to simplify fluid coupling to a subsea flowline that extends across the seabed 12 from a subsea well or other subsea installation.

Turning next to FIG. 2, this shows one of the risers 20 of FIG. 1 and is not to scale. A first embodiment of a bottom connector 24 of the invention is shown at the base of the riser 20.

A series of buoyancy modules 28 attached to the riser 20 imparts the desired compliant shape to the riser 20. Upper buoyancy modules 28 of the series are typically smaller than lower buoyancy modules 28 of the series as shown.

At its base, the bottom connector 24 connects the riser 20 to a pre-installed permanent subsea foundation shown in dashed lines, exemplified here as a suction pile 26. Most of the suction pile 26 is embedded in the seabed 12 but a minor upper portion of the suction pile 26 protrudes above the seabed 12 and is surrounded by a horizontally-projecting mudmat 30 that sits on the seabed 12.

The suction pile 26 is also surmounted by an integral hollow guide base 32 that serves as a close-fitting complementary interface with the bottom connector 24. The guide base 32 comprises an upwardly-opening tubular socket 34 and a downwardly-tapering guide formation 36 that flares upwardly and outwardly from the top of the socket 34.

The bottom connector 24 comprises an engagement head 38 that hangs beneath a pivot joint assembly 40 to engage within the socket 34 of the guide base 32. The engagement head 38 and the pivot joint assembly 40 are aligned on, and are substantially symmetrical about, a common central longitudinal axis 42. The riser conduit 22 extends within the pivot joint assembly 40 along the central longitudinal axis 42 between an upper end of the bottom connector 24 and the engagement head 38.

The engagement head 38 tapers downwardly to cooperate with the similarly-inclined guide formation 36 of the foundation 26. The cooperation between those parts aligns the engagement head 38 with the socket 34 on a common axis, in particular the central longitudinal axis 42, as the bottom connector 24 is lowered substantially vertically toward engagement with the foundation 26. Correct azimuthal orientation between the engagement head 38 and the socket 34 is assured by orientation pins 44 that project laterally from the engagement head 38 to engage with complementary upwardly-opening guide slots of the socket 34.

When the engagement head 38 is fully engaged within the socket 34 on the correct azimuth, a lock pin 46 at the downward extremity of the engagement head 38 is engaged with a complementary recess 48 at the base of the socket 34. This locks the bottom connector 24 and hence the riser 20 to the suction pile 26.

On its upper side, the engagement head 38 has matching frusto-conical funnels 50, 52 that are diametrically opposed to each other about, and with equal spacing from, the central longitudinal axis 42. The funnels 50, 52 flare and open upwardly.

A first funnel 50 serves as a guide to facilitate subsea fluid coupling with an upwardly-facing API connector hub 54 at the base of the funnel 50. The connector hub 54 is at the free end of an upwardly-extending limb of a steel U-shaped pipe 56 within the engagement head 38. Advantageously, the connector hub 54 provides for direct connection to a subsea flowline without requiring an intermediate jumper pipe to connect to the flowline. In this example, the connector hub 54 is on a substantially vertical axis when the engagement head 38 is engaged with the socket 34.

The U-shaped pipe 56 is in fluid communication with the riser conduit 22. The connector hub 54 and most of the U-shaped pipe 56 are offset laterally from the central longitudinal axis 42, although an upwardly-extending limb of the U-shaped pipe 56 opposed to the connector hub 54 lies on the central longitudinal axis 42.

The other, second funnel 52 serves as a receptacle for a complementarily-shaped counterweight 58 to counterbalance the laterally-offset weight of the connector hub 54 and the U-shaped pipe 56 about the central longitudinal axis 42. Also, by virtue of being of similar size and shape to the first funnel 50, the second funnel 52 is a dummy counterpart of the first funnel 50. This balances the first funnel 50 hydrodynamically as the engagement head 38 moves through the water column toward the foundation 26 and as ocean currents flow past the engagement head 38.

With reference now also to FIG. 3, the counterweighted dummy second funnel 52 ensures that the engagement head 38 hangs substantially vertically from the pivot joint assembly 40 in a fully-balanced manner, despite any deflection of the remainder of the riser conduit 22 above the pivot joint assembly 40. This orientation promotes simple and reliable engagement between the engagement head 38 and the guide base 32. Thereafter, the pivot joint assembly 40 allows the remainder of the riser 20 to sway about the foundation 26 in response to ocean currents.

The pivot joint assembly 40 comprises upper and lower steel tubes 60, 62 that surround the riser conduit 22 and are joined end-to-end by a gimbal joint 64. The upper tube 60 is surmounted by a steel flange 66 that anchors a taper joint 68. The taper joint 68 tapers upwardly from the flange 66 and surrounds and is attached to, or is integral with, the riser conduit 22. The lower tube 62 is rigidly attached to the engagement head 38 by a steel end fitting 70 of the riser conduit 22 that is joined to the U-shaped pipe 56 at a welded joint 72. Tensile loads between the riser 20 and the suction pile 26 are carried by the upper and lower tubes 60, 62 and the gimbal joint 64 on a load path that bypasses the riser conduit 22 extending within the pivot joint assembly 40.

The gimbal joint 64 defines multiple pivot axes that extend orthogonally through the central longitudinal axis 42 to define a centre of rotation 74, enabling the base of the riser 20 to pivot freely relative to the suction pile 26 as the remainder of the riser conduit 22 deflects in response to ocean currents. The base of the riser 20 is free to pivot within an inverted conical volume 76 whose apex is at the centre of rotation 74.

Various universal joint arrangements are possible for the gimbal joint 64, such as a simple Hooke-type joint in which U-shaped yokes or forks are offset angularly by 90° about the central longitudinal axis 42. In that well-known arrangement, the forks are connected by a cross-shaped link that can pivot relative to the forks and that defines mutually-orthogonal pivot axes about which the respective forks can pivot. The riser conduit 22 can extend through a central opening in the link or can be diverted, curved or kinked to extend around the link, between the link and the forks. The latter option is preferred as a diversion lengthens the riser conduit 22 locally and allows for the riser conduit 22 to be shaped with a stress-relieving formation that promotes flexing of the riser conduit 22 around the centre of rotation 74.

By way of example, the upper and lower tubes 60, 62 may be about 6 m long so that the pivot joint assembly 40 is about 12 m long overall. The engagement head 38 may be about 3 m long from the tip of the lock pin 46 at the bottom to the top of the connector hub 54 positioned within the first funnel 50.

FIG. 4 shows a second embodiment of the bottom connector 24 that has several features in common with the first embodiment of the bottom connector 24 shown in FIGS. 2 and 3. Like numerals are therefore used for like features.

In the variant shown in FIG. 4, the pivot joint assembly 40 and the remainder of the riser 20 are separably coupled to the engagement head 38. This allows the engagement head 38 to be pre-installed in the guide base 32 atop the suction pile 26 and for the pivot joint assembly 40 and the remainder of the riser 20 to be coupled to the engagement head 38 in a subsequent operation. That operation is shown in progress in FIG. 4. Conversely, it is also possible to separate the pivot joint assembly and the remainder of the riser 20 from the engagement head 38 while leaving the engagement head 38 coupled mechanically with the guide base 32 on the seabed 12.

The variant of FIG. 4 also differs from the arrangement shown in FIGS. 2 and 3 in that the pivot joint assembly 40 comprises a flexible joint 78 instead of a gimbal joint. The flexible joint 78 also defines a centre of rotation 74 and so allows the base of the riser 20 to pivot freely relative to the suction pile 26 within an inverted conical volume 76 as the remainder of the riser conduit 22 deflects in response to ocean currents.

A flange 80 under the flexible joint 78 joins a subsea connector 82 to the flexible joint. In this example, the connector 82 is a downwardly-opening female connector 82 that complements an upwardly-facing male connector 84 extending along the central longitudinal axis 42 atop the engagement head 38. The male connector 84 engages within the female connector 82 when the pivot joint assembly 40 is lowered onto the engagement head 38. The male and female connectors 80, 82 thereby serve as a re-entry interface that effects fluid communication between the connector hub 54 and the riser conduit 22 via the U-shaped pipe 56.

Alignment of the female connector 82 with the male connector 84 on the central longitudinal axis 42 is assured by an orientation system that comprises an upwardly-extending guide post 86 on the engagement head 38. The guide post 86 is offset laterally to one side of, and extends parallel to, the central longitudinal axis 42. A complementary re-entry funnel 88 attached to the female connector 82 is, correspondingly, offset laterally to one side of, and extends parallel to, the central longitudinal axis 42. In particular, the guide post 86 and the re-entry funnel 88 are offset laterally to the same extent relative to the central longitudinal axis 42. The re-entry funnel 88 flares downwardly to admit the top of the guide post 86 as the pivot joint assembly 40 is lowered onto the engagement head 38.

Further lowering of the re-entry funnel 88 along the guide post 86 engages a helical orientation formation 90 of the guide post with a complementary formation within the re-entry funnel. This turns the re-entry funnel 88 about the guide post 86, swinging the female connector 82 about the guide post 86 into axial alignment with the male connector 84 on the central longitudinal axis 42, until the re-entry funnel 88 engages with a key 92 at the bottom of the orientation formation 90. With axial alignment between the male and female connectors 82, 84 thereby assured, the re-entry funnel 88 slides down the guide post 86 as the pivot joint assembly 40 is lowered fully onto the engagement head 38 until the male and female connectors 82, 84 are fully engaged. Once the inter-engaged male and female connectors 82, 84 are sealed to each other, they define a flow path extending between them that is in fluid communication with the connector hub 54, via the U-shaped pipe 56, and with the riser conduit 22.

Many other variations are possible within the inventive concept. For example, a bottom connector of the invention may be used with other lightweight pipes such as unbonded flexible pipe. A length of bonded or unbonded flexible pipe may extend along the bottom connector and in particular through or around the centre of rotation where the parts of the connector can pivot relative to each other.

The invention claimed is:

1. An end fitting for a subsea riser, the end fitting comprising:

an engagement head that is arranged to be engaged with a subsea foundation in a longitudinal engagement direction;

a structure surrounding a longitudinally extending flow axis, which structure is arranged to bear a tensile load on a load path that extends longitudinally from the engagement head in parallel to the flow axis, wherein the structure includes a pivot joint assembly having a first part that is attached to or integral with the engagement head and a second part that is pivotable relative to the first part about a centre of rotation that is substantially aligned with the flow axis;

a connector hub that is offset laterally from the flow axis;

a connector pipe in fluid communication with the connector hub, which pipe extends from the flow axis to the connector hub; and a counterweight that is opposed to the connector hub and the connector pipe about the flow axis;

wherein the engagement head is configured to support the connector hub, the connector pipe and the counterweight, and wherein the counter weight are located within a substantially matching pair of funnel formations.

2. The end fitting of claim 1, wherein the connector hub faces in a direction opposed to the engagement direction.

3. The end fitting of claim 1, wherein the connector hub faces in a direction substantially parallel to the flow axis.

4. The end fitting of claim 1, wherein the connector pipe is substantially U-shaped, defining a first limb that is aligned with the connector hub and a second limb that is aligned with the flow axis.

5. The end fitting of claim 1, wherein the pair of funnel formations is substantially bisected by a central plane that contains the flow axis.

6. The end fitting of claim 1, attached to a riser conduit that is coaxial with the flow axis.

7. The end fitting of claim 6, wherein the riser conduit extends along the flow axis through the structure.

8. The end fitting of claim 1, wherein the structure is removably connectable to the engagement head.

9. The end fitting of claim 8, wherein the structure is connectable to the engagement head by a subsea connector comprising complementary connector elements that surround the flow axis when inter-engaged.

10. The end fitting of claim 9, wherein the engagement head and the structure comprise complementary guide parts that are spaced laterally from the flow axis and that are inter-engageable along an alignment axis that extends parallel to the flow axis.

11. The end fitting of claim 10, wherein the guide parts have complementary helical orientation formations that are arranged to move one of the connector elements into alignment with the other of the connector elements on the flow axis.

12. The end fitting of claim 1, wherein the first and second parts of the pivot joint assembly are joined by a universal joint or a flexible joint.

13. A subsea riser comprising an end fitting of claim 1.

14. The riser of claim 13, comprising a riser conduit of composite pipe or flexible pipe.

15. The riser of claim 13, when engaged with the subsea foundation and with the flow axis of the end fitting in a substantially vertical orientation.

16. An engagement head for a subsea riser, the engagement head being arranged to be engaged with a subsea foundation in a longitudinal engagement direction and comprising:

a connector hub that is offset laterally from a central longitudinally extending flow axis; a connector pipe in fluid communication with the connector hub, which pipe extends from the flow axis to the connector hub; and a counterweight that is opposed to the connector hub and the connector pipe about the flow axis, wherein the connector hub and the counterweight are located within respective funnel formations;

further comprising a pivot joint assembly having a first part that is attachable to or integral with the engagement head and a second part that is pivotable relative to the first part about a centre of rotation that is substantially aligned with the flow axis.

17. The engagement head of claim 16, wherein the connector hub and the counterweight are disposed substantially symmetrically about the flow axis.

18. A method of installing a subsea riser, comprising:

lowering the riser toward a seabed foundation with at least a bottom end portion of the riser in a substantially vertical orientation;

in an engagement head at a bottom end of the riser, counterbalancing the weight of a connector hub that is offset laterally from a flow axis extending substantially vertically through the engagement head and the weight of a connector pipe that extends from the flow axis to the connector hub;

suspending the engagement head while allowing a conduit of the riser to pivot relative to the engagement head away from alignment with the flow axis that extends through the engagement head; and mechanically engaging the engagement head with the seabed foundation.

19. The method of claim 18, comprising moving the engagement head into engagement with the seabed foundation in a substantially vertical engagement direction.

20. The method of claim 18, comprising counterbalancing hydrodynamic forces that act on a guide funnel around the connector hub while lowering the riser, which forces are offset laterally from the flow axis that extends through the engagement head.

21. A method of installing a subsea riser, comprising:

lowering an engagement head while counterbalancing the weight of a connector hub that is offset laterally from a flow axis extending substantially vertically through the engagement head and the weight of a connector pipe that extends from the flow axis to the connector hub;

mechanically engaging the engagement head with the seabed foundation;

coupling a riser conduit to the engagement head engaged with the foundation; and allowing the riser conduit to pivot relative to the engagement head away from alignment with the flow axis that extends through the engagement head.

22. The method of claim 21, comprising guiding the riser conduit onto the flow axis that extends through the engagement head by inter-engaging complementary guide parts of the engagement head and of the riser conduit.

23. The method of claim 18, comprising supporting the connector hub in a substantially vertical orientation when the engagement head is engaged with the foundation.

24. The method of claim 21, comprising supporting the connector hub in a substantially vertical orientation when the engagement head is engaged with the foundation.

* * * * *